US005862579A

United States Patent [19]

Blumberg

[11] Patent Number: 5,862,579

[45] Date of Patent: Jan. 26, 1999

[54] FILE FASTENER METHOD OF MANUFACTURE

[75] Inventor: Murray B. Blumberg, Sandton, South Africa

[73] Assignee: Press Engineering (Proprietary) Company, Johannesburg, South Africa

[21] Appl. No.: 839,405

[22] Filed: Apr. 11, 1997

Related U.S. Application Data

[63] Continuation-in-part of Ser. No. 324,098, Oct. 14, 1994, Pat. No. 5,641,234.

[51] Int. Cl.[6] ..... B21F 45/22; B42F 13/00

[52] U.S. Cl. ..... 29/417; 29/412; 29/13; 402/8; 402/14

[58] Field of Search ..... 29/412, 417, 13, 29/33.5; 402/7, 8, 13, 14, 19, 80 R, 70, 73, 75; 72/46; 281/27.3; 411/901, 902, 903, 442, 443

[56] References Cited

U.S. PATENT DOCUMENTS

| | | | |
|---|---|---|---|
| 0,185,457 | 12/1876 | Shinn | 29/13 |
| 0,677,588 | 7/1901 | Neider | 29/13 |
| 1,465,783 | 8/1923 | Polzer . | |
| 1,744,948 | 1/1930 | Buckland | 402/14 |
| 1,939,631 | 12/1933 | Randall | 411/443 |
| 2,033,613 | 3/1936 | Crosby | 411/442 |
| 3,128,667 | 4/1964 | Tremblay | 411/443 |
| 3,741,385 | 6/1973 | Corey . | |
| 3,867,743 | 2/1975 | Corey . | |
| 4,093,387 | 6/1978 | Jönsson | 402/14 |
| 4,130,933 | 12/1978 | Demrick . | |
| 4,285,754 | 8/1981 | DiMatteo . | |
| 4,688,415 | 8/1987 | Pendelton | 29/13 |
| 4,950,097 | 8/1990 | Blumberg . | |
| 4,993,861 | 2/1991 | Blumberg et al. . | |
| 5,007,758 | 4/1991 | Blumberg . | |
| 5,011,318 | 4/1991 | Gilmore . | |
| 5,059,051 | 10/1991 | Corey . | |

FOREIGN PATENT DOCUMENTS

| | | | |
|---|---|---|---|
| 0431579 | 7/1926 | Germany | 29/13 |
| 0574871 | 12/1993 | Japan | 402/9 |

*Primary Examiner*—Frances Han
*Attorney, Agent, or Firm*—Wood, Herron & Evans, L.L.P.

[57] ABSTRACT

A method of manufacturing a file fastener from a flat metal strip having top and bottom surfaces with narrow side surfaces therebetween, includes providing an elongate body portion. A prong extends from each end of the body portion, with at least the side surfaces of the prongs having a protective coating. The invention extends to a method of manufacturing a string of file fasteners, each file fastener being of a flat metal strip having an elongate body portion. A prong extends from each end of the body portion, with the file fasteners being connected via frangible bridges.

9 Claims, 3 Drawing Sheets

FILE FASTENER METHOD OF MANUFACTURE

This application is a continuation-in-part application based on U.S. patent application Ser. No. 08/324,098 filed on Oct. 14, 1994, now U.S. Pat. No. 5,641,234.

FIELD OF INVENTION

This invention relates to a method of manufacturing a file fastener.

BACKGROUND OF THE INVENTION

File fasteners of the type set out in this specification have a central body portion and a prong extending from each end of the body portion, each prong being narrower than the body portion. File fasteners of this type are conventionally produced using eccentric punch presses.

It has become practice to attach the central body portion of the fastener to a folder. The body portion is usually either mechanically attached to the folder or adhered to the folder. One example of mechanical attachment occurs via lugs which extend from the body portion into openings defined in the folder. In one example of when the body portion is adhered to the folder, a prong is received through each of a pair of openings defined in a length of adhesive tape. This particular method of attachment is described in U.S. Pat. No. 5,059,051 (Corey).

The prongs of fasteners which are attached to folders are usually coated with a suitable material such as paint. The purpose of this is to protect a user from being cut and to inhibit oxidation of the prongs.

The inventor has communicated with and visited leading manufacturers of file fasteners all over the world. The inventor has familiarized himself with the technology of a number of these file fastener manufacturers.

Egidius Jansen of The Netherlands, is the leading manufacturer of file fasteners in Europe. Egidius Jansen manufactures file fasteners from either tin plated material which is pre-plated or pre-lacquered. The fasteners are then blanked from such pre-plated or pre-lacquered material. This leaves the edges and the tips of the fastener exposed.

The inventor believes that VanGuard Tool & Die of Milwaukee, Wis., U.S.A., is the leading manufacturer in the U.S.A. of the "lug"-type fasteners described above.

VanGuard's operation is relatively sophisticated. It employs high speed punch presses, carbide dies and the latest technology and equipment available. VanGuard's operation is also highly automated with conveyorized automatic removal of scrap from the premises. VanGuard uses pre-coated coil for the manufacture of the file fasteners. VanGuard's fasteners are blanked from the precoated coil. The edges and the tips of the fasteners are thus also exposed.

Ideal Stampings of Philadelphia, Pa., U.S.A., manufactures tin-plated file fasteners. These fasteners are inserted into file folders by end users. Ideal Stampings does not manufacture a coated fastener. It follows that edges and tips of these fasteners remain exposed after blanking.

Grip Binders' is the largest manufacturer of file fasteners in South Africa and their operation is also a relatively sophisticated one using high speed presses and carbide dies. At present, Grip Binders, as with Ideal Stampings, only manufactures tin-plated fasteners. The fasteners are manufactured from preplated stock, leaving the edges and tips of such fasteners unplated.

Charles Leonard and Company of Glendale, N.Y., U.S.A. manufactures coated fasteners. These fasteners are manufactured from pre-coated material. Thus, the edges and tips of the fasteners remain exposed.

A problem which has arisen during the manufacture of file fasteners is that the blank perimeter of a file fastener can be burred. This results from the blanking process. This problem has to some extent been overcome by a striking operation known as "spanking" the burr which is done in an additional stage in the die. This striking operation is designed to flatten the burr.

This method has been partially successful. However, a residual burr often remains as the die becomes blunt and requires removal of the die for sharpening. Thus, a substantial number of burred fasteners can move through the production process without being detected.

The fasteners are coated in an attempt to solve this problem. However, when the fasteners are blanked from pre-coated material, the edges and the tips remain unprotected as a result of the blanking process. Until now, it has not been possible for manufacturers to obtain a commercially viable solution to this problem.

Oxidation of uncoated edges can occur. This oxidation in combination with a burr can result in a dangerous cut to the fingers of an end user. The fasteners are a high volume product and hundreds of millions are manufactured and used in the United States annually. Moreover, users are required to bend the prongs into an upright, vertical position to accept the papers to be filed. The prongs must then be bent back into a horizontal position. It will be appreciated that users' fingers are in direct contact with the edges and the tips of such prongs frequently and continuously.

Further, when the fasteners are used in combination with compressor bars it is necessary to fold the prongs inwards over the compressor bar. A locking member is then slid across the prongs to secure the prongs in position. This results in a movement of fingers across the prongs. Any residual burr on the prong edges can thus cut a user's fingers.

It is clear that, although some progress has been made in preventing injury due to uncoated edges and tips, a commercially viable method of coating the edges and the tips of fasteners to prevent injury altogether has not been achieved to date.

A further problem associated with uncoated edges and tips is that edges of punched holes in paper are damaged by such uncoated edges and tips. This problem is common knowledge to users of files and file fasteners.

An attempt to solve this problem has been the use of self-adhesive reinforcing rings. However, the attachment of such reinforcing rings constitutes an additional cost. Further, the use of such rings is regarded as a nuisance or burden and, as a result, the rings are not used in the majority of cases. The reinforcing rings also result in the need for extra filing space.

Up until the present invention, the problems of having uncoated edges and tips as set out above have been regarded as insoluble. Prior to the invention, the most efficient and economically viable method of manufacturing fasteners of the type having a central body portion of greater width than the prongs was to blank the fasteners out of a sheet of metal in a single stroke. Such fasteners are typically manufactured at speeds of between three hundred and six hundred fasteners per minute.

The conventional methods of coating finished products entails the preforming or blanking of the product, and the coating of the product thereafter, in order to cover all sides of the product. This involves individually handling the product after blanking or forming in order to coat all sides. It will be appreciated that should the file fasteners be coated in this manner, the cost of manufacturing the file fastener would render the file fastener commercially uncompetitive. In order to be commercially viable, file fasteners sell for between US$0.01 and US$0.017 each (ex-factory). This price could not be achieved if the file fasteners were individually handled for coating after they were formed.

In order to coat the fasteners separately, the fasteners must be collected, oriented correctly, and held in a jig or holding device, in order to be coated. It follows that a portion of each fastener must necessarily be covered over by the holding device, resulting in an uncoated portion or patch corresponding to the holding area.

A disadvantage of such separate coating is that it would rule out roller coating the fasteners.

The most significant disadvantage of holding the individual fasteners, is that the handling would drive the cost of coating up to a price which would be substantially more than the cost of the fastener itself. As a result, the fastener would be commercially uncompetitive.

The inventor believes that this invention provides a method whereby a file fastener of the type described above and having prongs with coated edges and tips can be manufactured in a commercially viable manner.

SUMMARY OF INVENTION

According to the invention, there is provided a method of manufacturing a file fastener, which is of a flat metal strip having an elongate body portion with a prong extending from each end of the body portion, each prong being narrower than the body portion and with each prong terminating in a tip, the body portion and the prongs having top and bottom surfaces and narrow side surfaces therebetween, the method including the steps of:

forming the body portion and the prongs; and applying a protective coating to substantially the entire side surfaces of the prongs and their tips.

The method may include applying the protective coating to the top and bottom surfaces of both prongs and their tips to cover substantially the whole of each prong.

The method may include applying the protective coating to the body portion as well.

The file fastener may be parted from a sheet of the metal. The body portion and the prongs may be parted in at least two separate operations. In particular, the prongs may be parted in a first operation and the protective coating applied to substantially the entire side surfaces of the prongs and their tips in a second operation. The body portions may then be parted in a third operation.

The fasteners may be parted from the sheet of metal so that the body portions of the fasteners are adjacent one another to provide a string of file fasteners, the file fasteners being connected via frangible bridges.

The fasteners may be parted so that each fastener is attached, at an end of at least one prong, to a ribbon, via a frangible bridge. Conveniently the fasteners may be attached, at the end of both prongs, to ribbons, via frangible bridges.

Instead, the fasteners may be parted so that the body portion of each fastener is connected to the body portion of an adjacent fastener by a frangible bridge.

In a further embodiment, the fasteners may be parted so that each fastener is attached at a position between a free end and an opposed end of at least one prong, to the prong of an adjacent fastener via a frangible bridge. Again, the fasteners may be attached at a position between the free end and the opposed end of both prongs to an adjacent fastener, via frangible bridges.

The method may include coating substantially the entire top and bottom surfaces and side surfaces of each prong and its tip of the fasteners of the string with the protective coating. The top and bottom surfaces of the body portions of the fasteners of the string may also be coated with the protective coating.

The invention is now described, by way of example, with reference to the accompanying drawings.

DETAILED DESCRIPTION OF THE DRAWINGS

Figure 1:
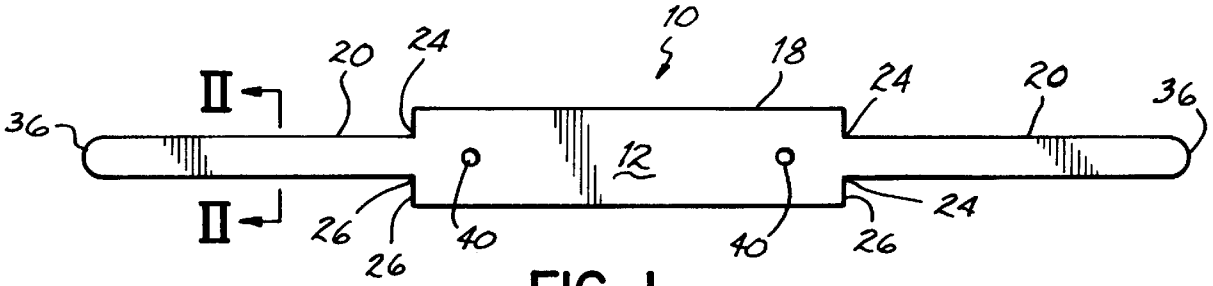
FIG. 1 shows a file fastener which is manufactured in accordance with a method of the invention.

In the drawings, reference numeral 10 generally indicates a file fastener which has been manufactured in accordance with a method of the invention.

The file fastener 10 is of flat metal strip. The file fastener 10 has an elongate body portion 18 with a prong 20 extending from each end of the body portion 18. Each prong 20 is narrower than the body portion 18 and terminates in a tip 36. The body portion 18 and the prongs 20 have top and bottom surfaces 12, 14 and narrow side surfaces 16 therebetween.

The side surfaces 16 and the top and bottom surfaces 12, 14 of the prongs 20 have a protective coating 22.

Each prong 20 is narrower than the body portion 18 to define a pair of shoulders 24 at each end of the body portion 18. The shoulders 24 are substantially square.

Figure 3:
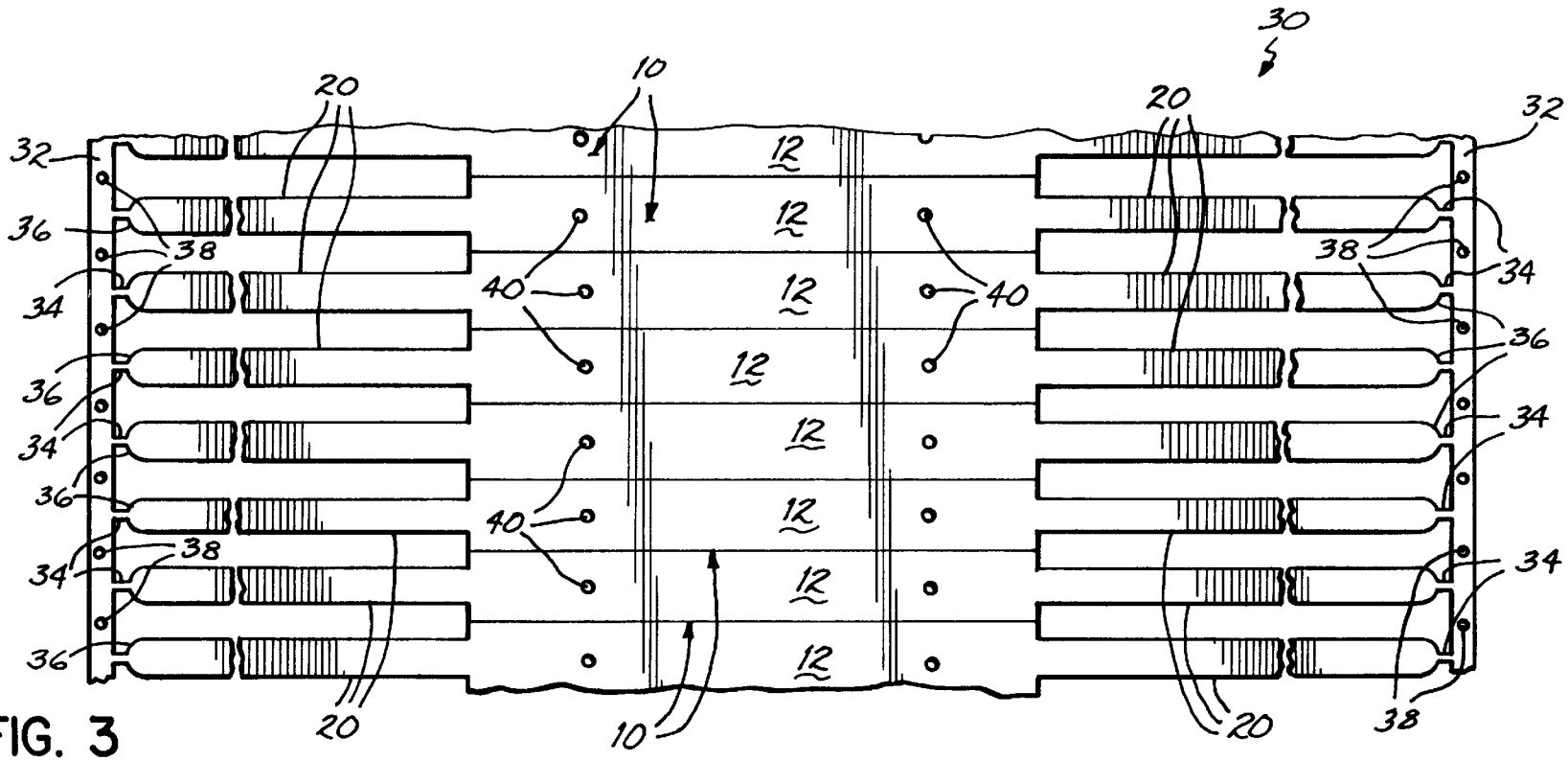
FIG. 3 shows a string of file fasteners manufactured in accordance with a first embodiment of the method.
Figure 4:
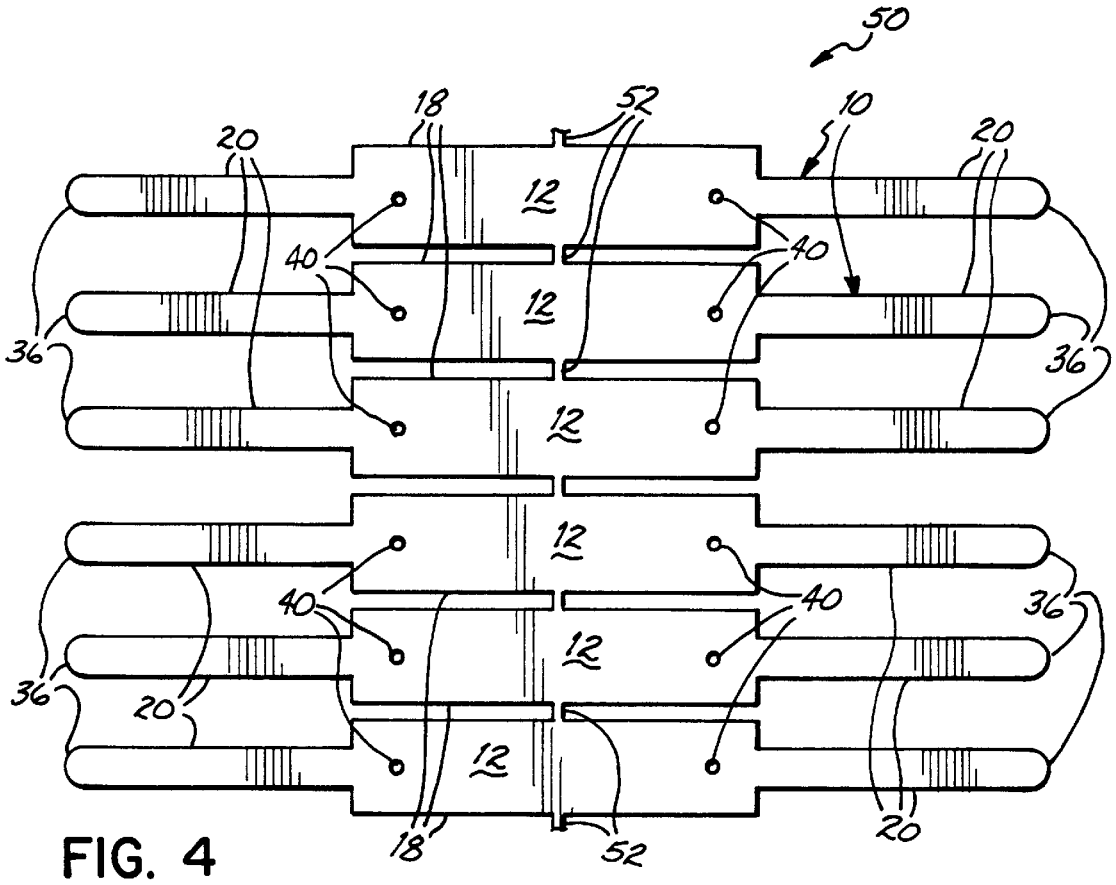
FIG. 4 shows a string of file fasteners manufactured in accordance with a second embodiment of the method.

In FIG. 3, reference numeral 30 generally indicates a string of the file fasteners 10, the string 30 being manufactured in accordance with a first embodiment of the method of the invention.

The string 30 is manufactured by parting the body portions 18 and the prongs 20 from a sheet of metal. The sheet of metal is parted so that the body portions 18 are adjacent one another to provide the string 30. The tip 36 of each prong 20 is connected to a ribbon 32 via a frangible bridge 34 between each tip 36 and its associated ribbon 32.

The string 30 is moved through a coating apparatus (not shown) so that the top and bottom surfaces 12, 14 and the side surfaces 16 of the prongs 20 are coated with the protective coating 22. The ribbons 32 have apertures 38 defined therein by means of which the string 30 can be moved through the coating apparatus. The body portions 18 also have apertures 40 defined therein to facilitate manipulation of the string 30.

Figure 2:
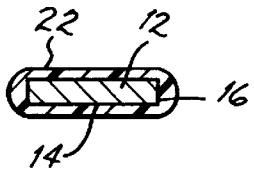
FIG. 2 shows a cross-sectioned view of the file fastener taken through II—II in FIG. 1.

The ribbons 32 and the fasteners 10 are formed by a punching operation, using suitable dies. The fasteners 10 can be formed one at a time in one operation or they can be formed in a plurality of punching operations, again one fastener 10 being formed at a time with each operating stroke, or a plurality of fasteners 10 being formed at a time with each operating stroke. It will be appreciated that, during the operations material between the prongs 20 is removed, the adjacent body portions 18 in accordance with a second embodiment of the method of the invention. With reference to FIGS. 1 to 3, like reference numerals refer to like parts, unless otherwise specified.

The string 50 is formed by parting the fasteners 10 from a sheet of metal so that the body portions 18 are arranged adjacent each other with the body portion 18 of each fastener 10 being connected to the body portion 18 of an adjacent fastener 10 by a frangible bridge 52.

The string 50 is manufactured in a similar manner to the string 30. However, with the string 50 a parting cut between the body portions 18 is not made. Material between the body portions 18 is removed in a similar manner as the removal of material between the prongs 20. The material between the body portions 18 is removed so that the bridges 52 remain.

It will be appreciated that with the string 50, the ribbons 32 can be dispensed with, thereby obviating the small uncoated tip areas which result when the ribbons 32 are utilized, the entire side surfaces 16 of the tips 36 being coated.

Figure 5:
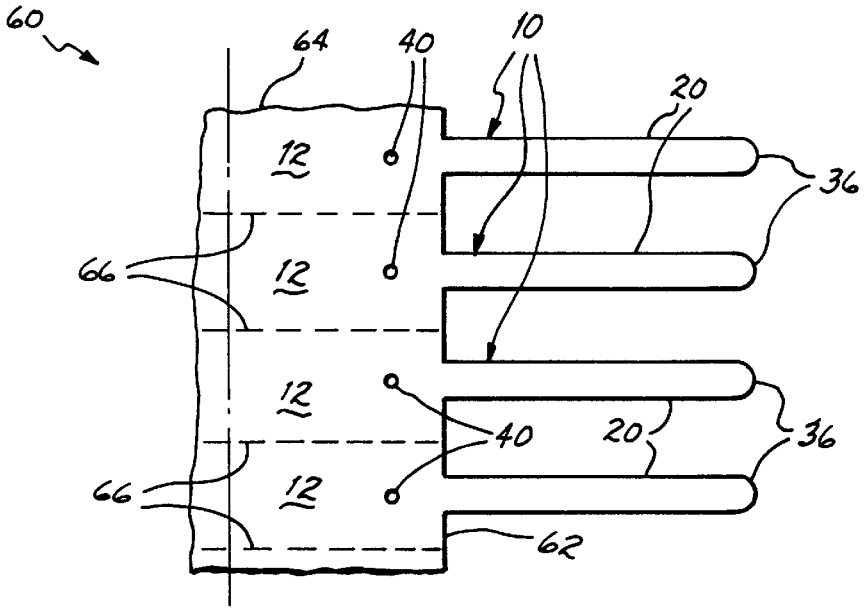
FIG. 5 shows a sheet of metal from which material has been removed to form prongs of the fasteners in accordance with a third embodiment of the method.

In FIG. 5, reference numeral 60 generally indicates a metal sheet from which material has been removed to form the prongs 20 in accordance with a third embodiment of the method of the invention. With reference to FIGS. 1 to 4, like reference numerals refer to like parts, unless otherwise specified.

In this embodiment, the fasteners 10 are formed by first removing material from a metal sheet so that prongs 20 of the fasteners 10 to be formed extend from opposed edges 62 of a central portion 64 of the sheet 60. The sheet 60 is then passed through a coating apparatus (not shown) to coat the entire top and bottom surfaces 12, 14, and the side surfaces 1 6 of the tips 36 and the prongs 20 with the protective coating 22.

The fasteners 10 are then parted from the sheet 60 by cutting the sheet 60 along the dotted lines indicated at 66.

Figure 6:
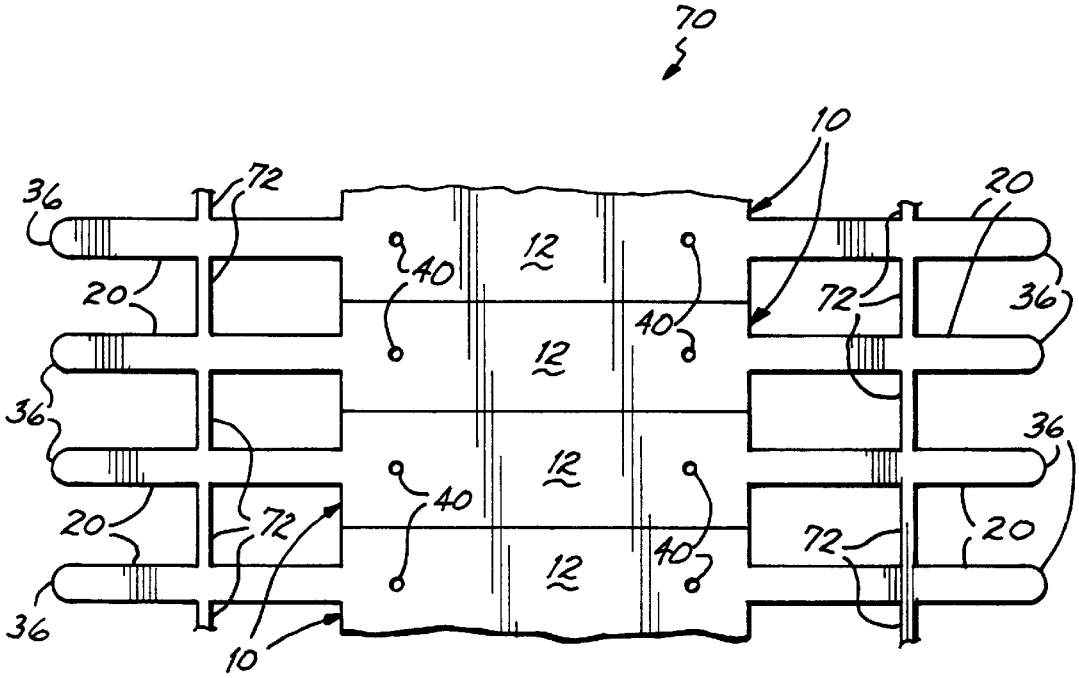
FIG. 6 shows a string of file fasteners manufactured in accordance with a fourth embodiment of the method.

In FIG. 6, reference numeral 70 generally indicates a string of the file fasteners 10 manufactured in accordance with a fourth embodiment of the method of the invention. With reference to FIGS. 1 to 5, like reference numerals refer to like parts, unless otherwise specified.

The string 70 is manufactured according to a method which is similar to that used for the string 30. However, with the string 70, the material is removed between the prongs 20 so that a frangible bridge 72 remains between each pair of adjacent prongs 20.

It will be appreciated that, as with the string 50, the sheet 60 and the string 70 permit the entire tips 36 of each fastener 10 to be coated, with only a very small area of the side surfaces of the prongs 20 being uncoated, when the bridges 72 are separated from the prongs 20.

We claim:

1. A method of manufacturing a file fastener, which is of a flat metal strip having an elongate body portion with a prong extending from each end of the body portion, each prong being narrower than the body portion and with each prong terminating in a tip, the body portion and the prongs having top and bottom surfaces and narrow side surfaces therebetween, the method including the steps of:

parting the prongs from a sheet of metal in a first operation to provide a central sheet with the prongs of unformed fasteners extending from the central sheet;

applying a protective coating to substantially the entire side surfaces of the prongs and their tips in a second operation; and parting the body portions from the central sheet in a third operation.

2. The method as claimed in claim 1, which includes applying the protective coating to the top and bottom surfaces of both prongs and their tips to cover substantially the whole of each prong.

3. The method as claimed in claim 2, which includes applying the protective coating to the body portion as well.

4. The method as claimed in claim 1, in which the sheet of metal is cut to form a plurality of the fasteners connected.

5. The method as claimed in claim 4, in which the sheet of metal is cut so that each fastener is attached, at an end of at least one prong, to a ribbon, via a frangible bridge.

6. The method as claimed in claim 5, in which the sheet of metal is cut so that each fastener is attached, at the end of each prong, to a ribbon, via a frangible bridge.

7. The method as claimed in claim 4, in which the sheet of metal is cut so that the body portion of each fastener is connected to the body portion of an adjacent fastener by a frangible bridge.

8. The method as claimed in claim 4, in which the sheet is cut so that each fastener is attached at a position between a free end and an opposed end of at least one prong, to the prong of an adjacent fastener via a frangible bridge.

9. The method as claimed in claim 8, in which the sheet is cut so that each fastener is attached at a position between the free end and the opposed end of each prong to the prong of an adjacent fastener via a frangible bridge.

* * * * *